US005401101A

United States Patent [19]

Wang

[11] Patent Number: 5,401,101

[45] Date of Patent: Mar. 28, 1995

[54] BAG

[76] Inventor: Paul S. Wang, 13620 Benson Ave., Chino, Calif. 91710

[21] Appl. No.: 214,987

[22] Filed: Mar. 21, 1994

[51] Int. Cl.[6] ..... B65D 30/06; B65D 33/06

[52] U.S. Cl. ..... 383/6; 383/41; 383/66; 383/117

[58] Field of Search ..... 383/117, 66, 41, 6

[56] References Cited

U.S. PATENT DOCUMENTS

| | | | |
|---|---|---|---|
| 675,415 | 6/1901 | Sansone | 383/41 |
| 1,215,868 | 2/1917 | Rosenfeld | 383/41 |
| 1,725,864 | 8/1929 | James | 383/117 |
| 2,431,452 | 11/1947 | Barkl | 383/66 |
| 2,493,085 | 1/1950 | Pincus | 383/6 |
| 2,897,863 | 8/1959 | Somers, Jr. | 383/41 |
| 3,173,464 | 3/1965 | Curtis | 383/41 |
| 4,949,842 | 8/1990 | Mokiao, II | 383/117 |
| 5,092,682 | 3/1992 | Fenick | 383/117 |

*Primary Examiner*—Stephen P. Garbe

[57] ABSTRACT

A mesh bag is provided for toys, laundry and beach use, and the like, which is formed of a tubular lower portion of a mesh material, and which has an open top, a closed bottom, and overlapping sides which form a side opening. A solid fabric upper portion of the bag is secured to the lower portion and surrounds the open top of the lower portion. The solid fabric upper portion extends across the top of the overlapping sides to assist in holding the side opening in a closed condition. A plastic tube is sewn to the upper rim of the upper portion, and it serves to flatten out the sides of the upper rim and hold the top of the bag closed. A pair of upwardly-extending loop handles are attached to the upper portion on opposite sides of the bag.

5 Claims, 1 Drawing Sheet

BAG

BACKGROUND OF THE INVENTION

The invention relates to an improved mesh bag which may be used, for example, as a toy bag, laundry bag, beach bag, and the like.

The bag of the invention is constructed of a suitable mesh material. The bag has an overlapped side opening to facilitate the taking of toys or other articles from the bag without the need the empty out all the contents of the bag.

A solid fabric piece is provided around the open top of the bag, and this piece overlaps the top of the side opening of the bag. The solid fabric piece enhances the strength of the mesh bag, and it also serves to hold the overlapped side opening of the bag is a closed condition to assure that articles will not fall out of the side opening, as mentioned above.

The bag is also equipped with a plastic tube with is sewn around the rim of the open top of the bag. The tube is shaped to flatten out the sides of the open top of the bag and hold it closed, making it easier to hang the bag on doorknobs, or the like.

DETAILED DESCRIPTION OF THE ILLUSTRATED EMBODIMENT

Figure 1:
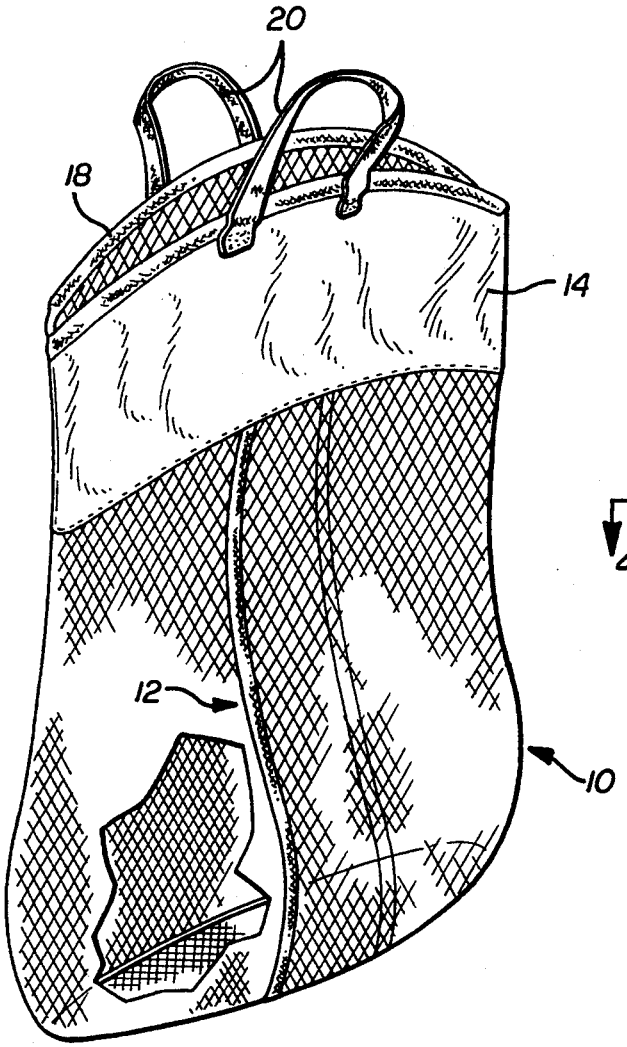
FIG. 1 is a side perspective view of a bag representing one embodiment of the invention.
Figure 2:
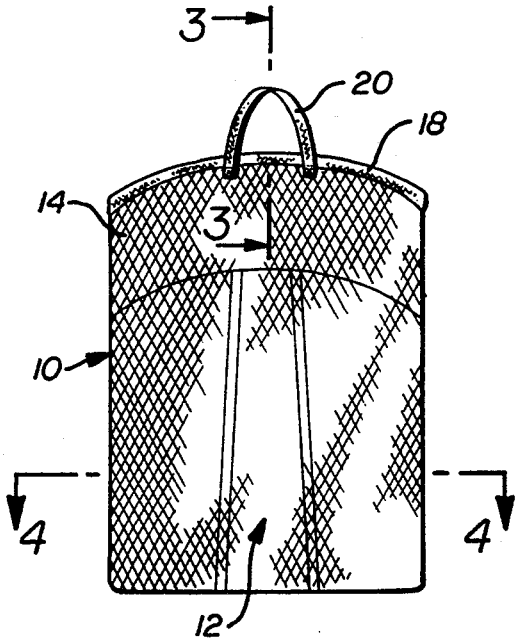
FIG. 2 is a side elevational view of the bag of FIG. 1 on a reduced scale.
Figure 3:
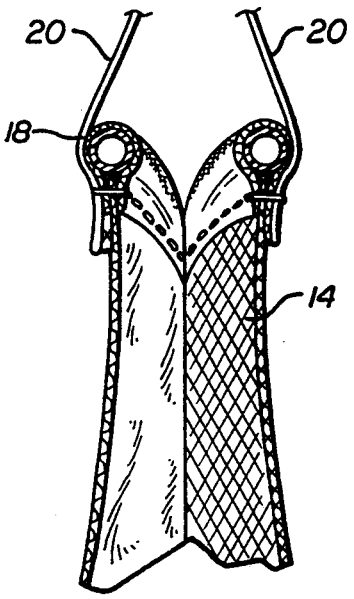
FIG. 3 is a sectional view of the bag of FIG. 2 taken along the line 3—3.
Figure 4:
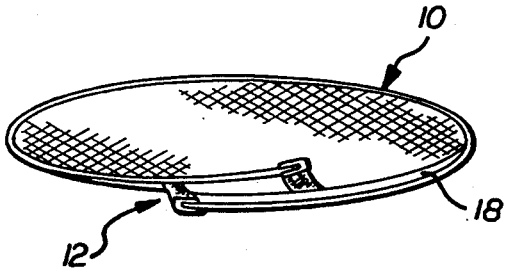
FIG. 4 is a sectional view of the bag of FIG. 2 taken along the line 4–4.

The bag shown in the drawings includes a lower tubular portion 10 formed of appropriate mesh material. The lower tubular portion 10 has a closed bottom and an open top. The sides of the tubular portion 10 are caused to overlap one another as designated by 12 to form a side opening.

The bag also includes an upper portion 14 formed of a fabric piece which is attached to the upper open end of the lower portion 10, and which extends around the upper end of the lower portion. The piece 14 extends across the overlapping portions 12 of the lower portion 10, and it serves to hold the overlapping portions in a closed position so that articles within the bag will not fall out through the side opening.

A plastic tube 18 is sewn to the upper rim of the fabric piece 14 and it serves to flatten out the sides of the top of the bag. A pair of loop handles 20 are attached to the upper rim of the fabric piece 14.

As stated above, the bag of the invention has a feature of providing a side opening which permits toys and other articles to be taken out of the bag individually without the need to dump all the contents of the bag. Also, the plastic tube 18 serves to hold the bag in a closed position so that the bag may be conveniently hung on a doorknob, or the like.

It will be appreciated that while a particular embodiment of the bag of the invention has been shown and described, modifications may be made. It is intended in the claims to cover all such modifications which fall within the true spirit and scope of the invention.

I claim:

1. A bag for toys, laundry, beach use, comprising: a tubular lower portion having an open top, a closed bottom, and overlapping sides forming a side opening, an upper portion secured to said lower portion and surrounding said open top, said upper portion extending across the overlapping sides of the tubular lower portion to hold the side opening in a closed position, and a pair of handles secured to said upper portion on opposite sides thereof.

2. The bag defined in claim 1, in which said tubular lower portion is formed of a mesh material.

3. The bag defined in claim 1, in which said upper portion is formed of a solid fabric material.

4. The bag defined in claim 1, and which includes a plastic tube attached to said upper portion and extending around the upper rim thereof to flatten out the sides of the upper rim.

5. The bag defined in claim 1, in which said handles are in the form of upwardly-extending loops.

* * * * *